US009766031B2

(12) United States Patent
Evans

(10) Patent No.: US 9,766,031 B2
(45) **Date of Patent: *Sep. 19, 2017**

(54) ARROW QUIVER

(71) Applicant: DEDtec, Inc., Plains, MT (US)

(72) Inventor: Daniel L. Evans, Trout Creek, MT (US)

(73) Assignee: DEDtec, Inc., Plains, MT (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/219,020

(22) Filed: Jul. 25, 2016

(65) Prior Publication Data

US 2016/0334183 A1 Nov. 17, 2016

Related U.S. Application Data

(63) Continuation of application No. 14/709,215, filed on May 11, 2015, now Pat. No. 9,400,153.

(60) Provisional application No. 61/990,848, filed on May 9, 2014.

(51) Int. Cl.
*F41B 5/06* (2006.01)
*F41B 5/14* (2006.01)

(52) U.S. Cl.
CPC ..... *F41B 5/066* (2013.01); *F41B 5/06* (2013.01); *F41B 5/1426* (2013.01); *Y10S 224/916* (2013.01)

(58) Field of Classification Search
CPC ..... F41B 5/066; F41B 5/1426; Y10S 224/916
USPC ..... 124/25.5, 25.7, 86, 88, 89; 224/916
See application file for complete search history.

(56) References Cited

U.S. PATENT DOCUMENTS 2,464,068 A * 3/1949 Bear ..... F41B 5/066 124/25.7
2,909,167 A * 10/1959 Fredrickson ..... F41B 5/14 124/24.1
2,980,305 A 4/1961 Reese
3,017,874 A * 1/1962 Gubash ..... F41B 5/066 124/25.7
3,406,675 A 10/1968 Fredrickson
3,465,928 A 9/1969 Osterholm
3,490,662 A 1/1970 Ramsey
3,595,215 A 7/1971 Wilkie et al.
3,601,113 A * 8/1971 Wilkie ..... F41B 5/066 124/25.7
4,020,984 A 5/1977 Morris
(Continued)

OTHER PUBLICATIONS

Official Action for U.S. Appl. No. 14/709,215, mailed Oct. 7, 2015 14 pages.

(Continued)

*Primary Examiner* — Alexander Niconovich
(74) *Attorney, Agent, or Firm* — Sheridan Ross PC

(57) ABSTRACT

A combined stabilizer/quiver for a bow is provided that may store arrows and may also function as a stabilizer. The combined stabilizer/quiver may comprise a shaft that extends forward from the front side of a bow and functions as a stabilizer, and arrows may be disposed substantially parallel to the shaft and contribute to the stabilizing function. With two components combined into one, the bow has less weight, improved accuracy and precision, and greater versatility. Alternatively, a quiver is provided which is adapted to attach to a conventional stabilizer which is attached to a riser of a bow.

10 Claims, 8 Drawing Sheets

(56) References Cited

U.S. PATENT DOCUMENTS 4,156,496 A * 5/1979 Stinson ..... F41B 5/066 124/25.7
4,247,027 A * 1/1981 Tardiff ..... F41B 5/066 124/25.7
4,522,187 A * 6/1985 Tafel ..... F41B 5/066 124/25.5
4,541,403 A * 9/1985 DeBlois ..... F41B 5/066 124/25.7
4,633,846 A 1/1987 Ipock
4,685,438 A 8/1987 Larson
4,788,961 A 12/1988 Toth
4,805,584 A * 2/1989 Stinson ..... F41B 5/066 124/25.5
4,823,764 A * 4/1989 Knaack ..... F41B 5/066 124/25.5
4,869,226 A 9/1989 Wu
4,907,567 A 3/1990 Henrich
4,955,356 A 9/1990 Pike et al.
4,957,095 A 9/1990 Cameron
5,107,819 A 4/1992 Pugh
5,190,022 A * 3/1993 Larson ..... F41B 5/066 124/25.5
5,205,272 A 4/1993 Boyer
5,259,359 A 11/1993 Meredith
5,265,584 A 11/1993 Judson
5,297,533 A 3/1994 Cook
5,452,703 A 9/1995 Bateman, III
5,558,078 A 9/1996 Dunlap
5,619,981 A 4/1997 Breedlove
5,803,069 A * 9/1998 Schreiber ..... F41B 5/063 124/25.7
5,904,134 A 5/1999 Denbow
5,944,004 A 8/1999 Goff et al.
5,992,403 A * 11/1999 Slates ..... F41B 5/1426 124/89
6,006,734 A * 12/1999 Sodaro ..... F41B 5/066 124/25.5
6,092,516 A 7/2000 Martin et al.
6,105,566 A * 8/2000 Tiedemann ..... F41B 5/066 124/25.7
6,330,881 B1 * 12/2001 Pippard ..... F41B 5/066 124/25.6
6,390,085 B1 * 5/2002 Stinson ..... F41B 5/066 124/25.7
6,431,162 B1 * 8/2002 Mizek ..... F41B 5/066 124/25.5
6,666,204 B1 * 12/2003 Hedrick ..... F41B 5/066 124/25.5
6,672,299 B2 * 1/2004 Proctor ..... F41B 5/066 124/86
6,691,694 B2 * 2/2004 Stinson ..... F41B 5/066 124/25.5
6,742,723 B2 6/2004 Felegy
6,845,765 B1 * 1/2005 Allshouse ..... F41B 5/1426 124/25.5
7,077,119 B1 * 7/2006 Dube, Sr. ..... F41B 5/12 124/25.5
7,275,528 B1 * 10/2007 Daigler ..... F41B 5/143 124/25.7
7,311,097 B1 * 12/2007 Callis ..... F41B 5/066 124/23.1
7,367,331 B1 5/2008 Horinek
7,464,908 B2 12/2008 Files
7,775,201 B2 * 8/2010 Cooper ..... F41B 5/14 124/25.5
7,942,141 B1 5/2011 Love et al.
7,987,842 B2 * 8/2011 McPherson ..... F41B 5/066 124/86
8,006,682 B2 * 8/2011 Vanek ..... F41B 5/066 124/25.5
8,434,467 B2 * 5/2013 LoRocco ..... F41B 5/066 124/86
8,505,527 B2 * 8/2013 Kempf ..... F41B 5/066 124/86
8,522,766 B2 9/2013 LoRocco
8,567,382 B2 10/2013 Kingsbury et al.
8,596,256 B2 12/2013 McPherson
8,714,147 B2 5/2014 Walk et al.
8,839,773 B2 9/2014 Ellig
8,839,776 B2 * 9/2014 Kingsbury ..... F41B 5/1426 124/1
8,899,221 B2 * 12/2014 Barnett ..... F41B 5/066 124/86
RE45,330 E 1/2015 Kempf
8,931,469 B2 1/2015 Kingsbury et al.
9,400,153 B2 7/2016 Evans
2007/0079821 A1 * 4/2007 Walk ..... F41B 5/066 124/86
2008/0302346 A1 * 12/2008 Notestine ..... F41B 5/066 124/25.7
2010/0170491 A1 * 7/2010 Roe ..... F41B 5/14 124/44.5
2010/0275896 A1 * 11/2010 Ellig ..... F41B 5/066 124/88
2012/0125307 A1 * 5/2012 Bromley ..... F41B 5/1442 124/88
2013/0092142 A1 * 4/2013 Kingsbury ..... F41B 5/066 124/88
2013/0167822 A1 * 7/2013 Walk ..... F41B 5/066 124/86
2013/0174824 A1 * 7/2013 Pedersen ..... F41B 5/066 124/86
2015/0184973 A1 * 7/2015 Martens ..... F41B 5/1426 124/23.1

OTHER PUBLICATIONS

Notice of Allowance for U.S. Appl. No. 14/709,215, mailed Mar. 18, 2016 13 pages.

* cited by examiner

ARROW QUIVER

CROSS-REFERENCE TO RELATED APPLICATIONS

This application is a continuation of U.S. patent application Ser. No. 14/709,215 filed May 11, 2015, which claims priority under 35 U.S.C. §119(e) to U.S. Provisional Patent Application Ser. No. 61/990,848 filed May 9, 2014, which is incorporated herein in its entirety by reference.

FIELD OF THE INVENTION

The invention generally relates to archery and bow accessories. More specifically, the invention relates to stabilizers, quivers, and combinations thereof.

BACKGROUND OF THE INVENTION

The field of archery is ancient, and the bow has long been a staple of hunting and warfare. In modern times, the tradition of archery continues recreationally and in hunting as most U.S. states designate a bow hunting season for certain animals. As archery has developed through the centuries, new features and accessories have been added to the bow.

One new feature of the modern bow is a stabilizer, which is typically a shaft-like mass that extends forward from the bow. When an arrow is launched from a bow, the arrow is subjected to a sudden propulsive force, and consequently the bow is subjected to a sudden and equal reactive force transmitted through the bow string. Often, this propulsive force is accompanied by a vertical or lateral torque that may cause the arrow to deviate from its desired flight path.

Stabilizers have three purposes for the archer: balance, vibration damping, and making the archer hold the bow steadier while aiming. The balancing goal is to steady a bow in an archer's hand so that it does not noticeably tip to either side or tip overly frontward or backward while aiming. Next, many stabilizers have some form of a vibration damping system to dissipate vibration caused by the released energy during the shot. Lastly, as an archer aims the bow, it is noticeably easier to grip the bow if there is some mass positioned forward of the bow. All else being equal, a stabilizer that extends farther out in front of the bow will make steadier aiming possible as compared to a shorter stabilizer. Further descriptions of a stabilizer may be found in U.S. Pat. Nos. 6,742,723 and 5,992,403, which are hereby incorporated by reference in their entirety.

Another feature of the modern bow is the quiver, which allows an archer to conveniently carry arrows, bolts, or darts. Quivers may be disposed on a belt, slung over the back of the archer, carried in the archer's hand, or carried in the archer's backpack. However, the modern trend is to attach the quiver to the bow itself. An example of such a quiver is described in U.S. Pat. No. 6,105,566, which is hereby incorporated by reference in its entirety.

A bow-mounted quiver has many drawbacks. First, the quiver obstructs the view of the archer. A bow-mounted quiver is vertically oriented and disposed on either side of the bow. This necessarily restricts the view of the archer which can endanger the archer. A bow hunter must stalk his or her target and be in close proximity with the target, and an obstructed view may cause the hunter to miss a visual cue from the animal: a mother protecting her young, a rutting bull, etc. Another drawback is the weight of the quiver. An archer must elevate the bow with his or her arms during use, and added weight can fatigue the archer.

The weight of the quiver is also offset from the bow's center of gravity. Most bow-mounted quivers on the market today hold arrows on the right side of a right hand bow (left side of a left hand bow) as viewed by the archer shooting the bow. This placement causes the bow to balance off-center toward the dominant hand of the shooter (i.e., to the right for a right handed shooter). Therefore, the weight and position of the quiver affects the accuracy and precision of the bow. To remedy the issues associated with a bow-mounted quiver the archer may carry the quiver by hand, on a backpack, or on a belt as mentioned above. However, this would necessitate the use of a belt or backpack or result in fatigue of the archer if the archer carried the quiver by hand.

SUMMARY OF THE INVENTION

It is thus an aspect of embodiments of the invention to provide a stabilizer/quiver that functions as both a quiver and a stabilizer. It is another aspect of embodiments of the invention to provide a stabilizer/quiver that reduces the overall weight of the bow and improves the reliability of the bow. A separate stabilizer and quiver configuration weighs more than a combined stabilizer/quiver because two components have been reduced to one. Further, because there are fewer components, the stabilizer/quiver is less susceptible to failure. Thus, a combined stabilizer/quiver improves the reliability of the bow.

It is another aspect of embodiments of the invention to improve the effectiveness of the bow by improving its accuracy and precision. In some embodiments of the invention, the quiver is substantially aligned with the center of mass of the bow such that the quiver does not pull the bow to one side. The resulting balance of the bow relieves the archer from one source of inaccuracy and imprecision, which results in a more effective bow.

It is a further aspect of embodiments of the invention to provide a more compact bow. While target archers prefer longer stabilizers, hunters necessarily require more discrete stabilizers so they can move about varied terrain and stalk their target. The invention provides a more compact stabilizer, and thus a more compact bow, because the quiver and arrows of the invention contribute to the mass extending forward from the bow. Thus, the quiver and arrows contribute to the stabilizing function of the stabilizer/quiver, and embodiments of the invention need not be as long as they otherwise would be. The resulting bow provides additional mobility for a hunter who needs to traverse varied terrain.

It is another aspect of embodiments of the invention to improve the safety of the archer, specifically the hunter. As mentioned above, a vertically oriented quiver obstructs the view of the hunter, and the hunter may miss visual cues from the target, animals such as the target's mother, or the environment. A combined stabilizer/quiver is generally horizontally oriented, and thus, the hunter maintains a clear view of his target and the surrounding environment. This allows the hunter to properly anticipate and/or mitigate any potential threats, which improves the overall safety of the hunter.

It is a further aspect of embodiments of the invention to provide a stabilizer/quiver that may detach and quickly disassemble. The stabilizer/quiver of the invention may attach to the bow and may be secured by components that are tightened by hand and not necessarily by other means such as an Allen wrench or a screwdriver. A hand-operated means for securing the stabilizer/quiver allows the archer to detach and quickly disassemble the quiver for easier carrying or storage without the necessity of carrying, or remembering to carry, the proper tool.

It is another aspect of embodiment of the invention to provide a stabilizer/quiver that is rotatable relative to a bow. In some embodiments of the invention, the default position for the stabilizer/quiver is extending forward from the bow and generally parallel with the ground when the bow is in a firing position. Thus, the stabilizer/quiver contributes to the overall stability of the bow. However, in other instances it may be advantageous to adjust the position of the stabilizer/quiver for easy storage, to adjust the stabilizing function, etc. In some embodiments, a bow attachment is used to interconnect the stabilizer/quiver to a portion of the bow such as the riser. The bow attachment may comprise two or more components disposed about an axis such that the stabilizer/quiver rotates relative to the bow. Further, the bow attachment may comprise a bolt, screw, or other similar device that is configured to lock the position of the stabilizer/quiver relative to the bow once the position of the stabilizer/quiver has been adjusted. The stabilizer/quiver may rotate about the rotatable bow attachment such that the stabilizer/quiver may rotate parallel with the riser of the bow similar to traditional bow-mounted quiver, or the stabilizer/quiver may be incrementally rotated to adjust the stabilizing effect of the stabilizer/quiver, access to the arrows, etc.

It is another aspect of embodiments of the invention to provide a stabilizer/quiver that comprises fully adjustable components. In some embodiments, the stabilizer/quiver comprises a shaft, a broadhead hood and an arrow gripper that secure arrows, and a bow attachment that interconnects the stabilizer/quiver to the bow. The broadhead hood, the arrow gripper, and the bow attachment may be disposed about the shaft in any order and in any position along the shaft. For example, these components may be arranged such that the shaft extends forward like a stabilizer, but the arrows are disposed rearward of the riser of the bow. In other embodiments, both the shaft and the arrows may be disposed forward of the riser of the bow or both disposed rearward of the riser.

It is another aspect of embodiments of the invention to provide a quiver/stabilizer that comprises an adjustable shaft. The shaft may comprise one or more hinged sections such that the position of the hinged sections and the relative angle between hinged sections is adjustable. In another example, the shaft is telescoping in nature. Therefore, an archer may fully extend the shaft to provide the greatest stabilizing effect, and the archer may collapse the shaft to any shorter length to provide more maneuverability or easier storage.

It is another aspect of the invention to provide a stabilizer/quiver that has an adjustable length in response to the number of arrows the stabilizer/quiver carries. In some embodiments of the invention, the stabilizer/quiver carries arrows and the stabilizer/quiver functions as a stabilizer. As a user selects arrows from the stabilizer/quiver and fires the arrows, the weight of the stabilizer/quiver changes, and the stabilizing properties of the stabilizer/quiver may also change. Thus, in some embodiments, the shaft of the stabilizer/quiver extends further out as each arrow is selected to compensate for the reduced weight of the stabilizer/quiver. This movement may be induced manually, for example, by a mechanical system such as a ratchet and pawl or automatically, for example, by an electrical system such as an electrical linear motor. Now the stabilizer/quiver may have consistent stabilizing properties, even as arrows are selected and fired.

It is another aspect of various embodiments of the invention to provide a stabilizer/quiver that is fully compatible with bow attachments and configurations. For example, modern bows often comprise platforms and components to attach aftermarket parts such as optics and sights. Embodiments of the invention may comprise a bow attachment that is adapted to interconnect to any other feature commonly incorporated in bows.

It is another aspect of embodiments of the invention to provide a broadhead hood that covers the broadheads of an arrow for safety purposes. In some embodiments, the broadhead hood comprises a housing with a broadhead hood insert, and a user may insert the broadhead of an arrow into the broadhead hood insert. Next, the user may engage an adjustable feature that compresses a portion of the broadhead hood insert such that the broadhead hood insert grips or locks the broadheads snuggly in the broadhead hood. The ability to grip or lock the broadheads reduces vibrations in the overall bow configuration and it also aids the archer by preventing arrows from falling out of the broadhead hood as the archer negotiates varied terrain. When the archer has established a position and needs access to the arrows, the archer may simply engage the adjustable feature to relieve the compression within the broadhead hood insert.

It is another aspect of embodiment of the invention to provide a stabilizer/quiver that selectively interconnects to an existing stabilizer. Many bows in circulation already comprise a stabilizer. Therefore, some embodiments of the invention may comprise features such as a broadhead hood and an arrow gripper that attach to the preexisting stabilizer to form a stabilizer/quiver. The arrow gripper and the broadhead hood may comprise adjustable means such that the arrow gripper and the broadhead hood may compress about the outer surface of the stabilizer. In other embodiments, the arrow gripper and broadhead hood snap onto the existing stabilizer. It will be appreciated that a variety of means to attach components to an existing stabilizer are discussed elsewhere herein and known in the art.

One particular embodiment of the invention is a combined stabilizer/quiver for a bow, comprising a shaft having a proximate end, a distal end, and an outer surface; a bow attachment feature located near the proximate end of the shaft, the bow attachment feature is adapted to secure the shaft to a bow; a broadhead hood disposed about the outer surface of the shaft, the broadhead hood comprising at least one recess configured to receive a first portion of an arrow; and an arrow gripper disposed about the outer surface of the shaft, the arrow gripper comprising at least one slot configured to receive a second portion of the arrow.

Another embodiment of the invention is a system for stabilizing a bow and storing arrows, comprising a bow having a riser, and an arrow having an arrowhead and a body; a shaft extending from the riser of the bow, the shaft having a proximate end, a distal end, and an outer surface; a broadhead hood disposed about the outer surface of the shaft, the broadhead hood comprising at least one recess, wherein the arrowhead of the arrow is positioned in the at least one slot; and an arrow gripper disposed about the outer surface of the shaft, the arrow gripper comprising at least one slot, wherein the body of the arrow is positioned in the at least one slot.

Yet another embodiment of the invention is a combined stabilizer/quiver for stabilizing a bow and storing arrows, comprising a shaft having a proximate end, a distal end, and an outer surface; a bow attachment feature located near the proximate end of the shaft, the bow attachment feature is adapted to secure the shaft to a bow; a broadhead hood disposed near the distal end of the shaft and about the outer surface of the shaft, the broadhead hood comprising a housing at least partially defining a volume; and a broadhead hood insert disposed in the volume and comprising at least one recess, the broadhead hood insert is compressible between a first volume and a second volume; a tension lever operably interconnected to the broadhead hood insert, the tension lever is moveable between a first position and a second position to compress the broadhead hood insert between the first volume and the second volume; and an arrow gripper disposed between the bow attachment feature and the broadhead, the arrow gripper disposed about the outer surface of the shaft, the arrow gripper comprising at least one slot configured to receive a body of the arrow.

These and other advantages will be apparent from the disclosure of the invention(s) contained herein. The above-described embodiments, objectives, and configurations are neither complete nor exhaustive. The Summary of the Invention is neither intended nor should it be construed as being representative of the full extent and scope of the invention. Moreover, references made herein to "the invention" or aspects thereof should be understood to mean certain embodiments of the invention and should not necessarily be construed as limiting all embodiments to a particular description. The invention is set forth in various levels of detail in the Summary of the Invention as well as in the attached drawings and Detailed Description and no limitation as to the scope of the invention is intended by either the inclusion or non-inclusion of elements, components, etc. in this Summary of the Invention. Additional aspects of the invention will become more readily apparent from the Detailed Description particularly when taken together with the drawings.

BRIEF DESCRIPTION OF THE DRAWINGS

The accompanying drawings, which are incorporated in and constitute a part of the specification, illustrate embodiments of the disclosure and together with the general description of the disclosure given above and the detailed description of the drawings given below, serve to explain the principles of the disclosures.

Figure 1:
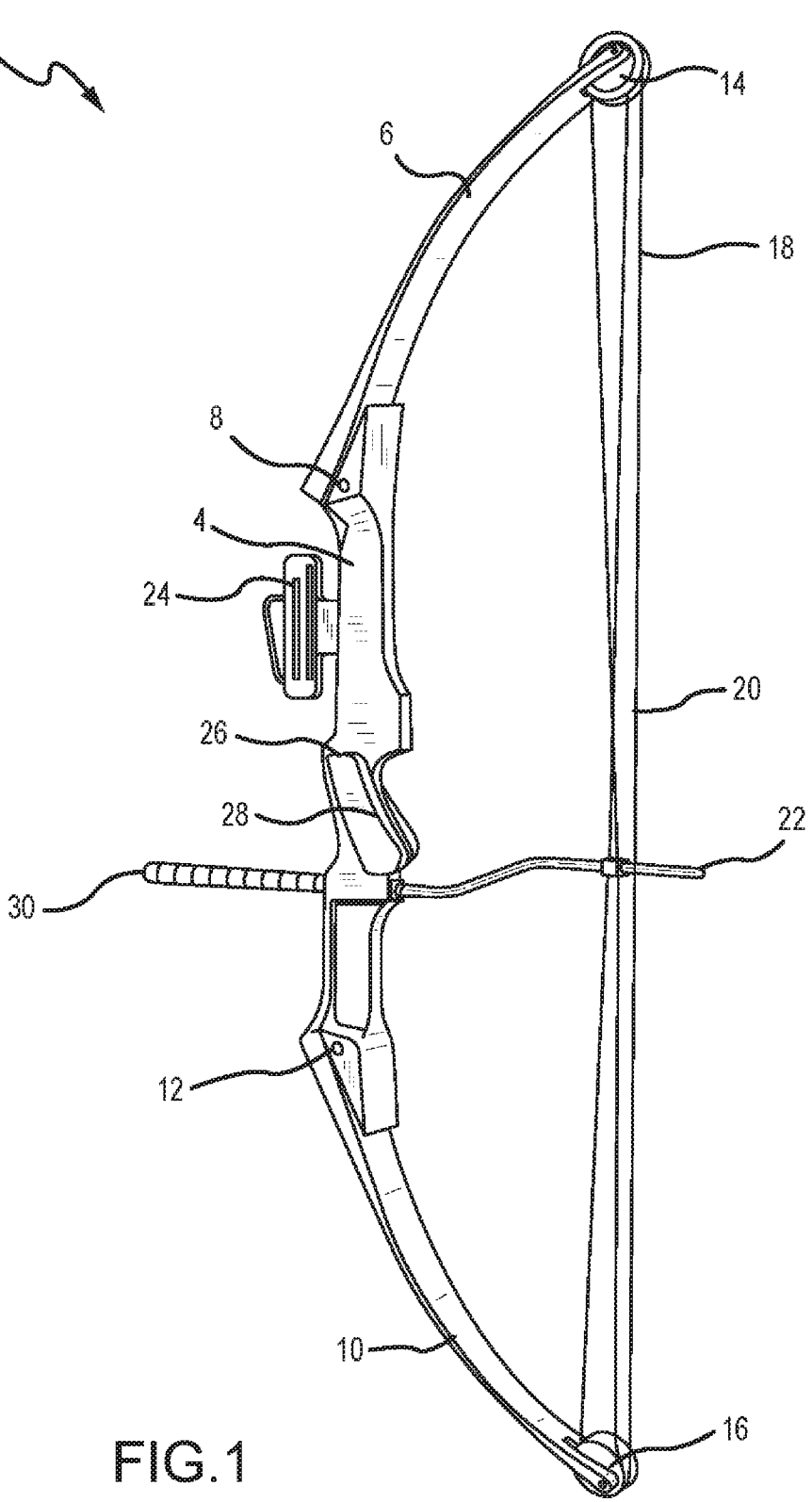
FIG. 1 is a side elevation view of a typical compound bow according to one embodiment of the invention.

To assist in the understanding of the embodiments of the invention the following list of components and associated numbering found in the drawings is provided herein:

| Component No. | Component |
|---|---|
| 2 | Bow |
| 4 | Riser |
| 6 | Upper Limb |
| 8 | Upper Bolt |
| 10 | Lower Limb |
| 12 | Lower Bolt |
| 14 | Upper Cam |
| 16 | Lower Cam |
| 18 | Bow String |
| 20 | Nocking Point |
| 22 | Cable Guard |
| 24 | Bow Sight |
| 26 | Arrow Rest |
| 28 | Grip |
| 30 | Stabilizer |
| 32 | Stabilizer/Quiver |
| 34 | Shaft |
| 36 | Arrow Gripper Bracket |
| 38 | First Portion |
| 40 | Second Portion |
| 42 | Arrow Gripper |
| 44 | Lockdown Bolt |
| 46 | Bow Attachment |
| 48 | Quick Detach Knob |
| 50 | Broadhead Hood |
| 52 | Broadhead Hood Insert |
| 54 | Arrow |
| 56 | Vertical Angle |
| 58 | Horizontal Angle |
| 60 | Tension Plate |
| 62 | Tension Lever |

It should be understood that the drawings are not necessarily to scale, and various dimensions may be altered. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

The invention has significant benefits across a broad spectrum of endeavors. It is the Applicant's intent that this specification and the claims appended hereto be accorded a breadth in keeping with the scope and spirit of the invention being disclosed despite what might appear to be limiting language imposed by the requirements of referring to the specific examples disclosed. To acquaint persons skilled in the pertinent arts most closely related to the invention, an embodiment that illustrates the best mode now contemplated for putting the invention into practice is described herein by, and with reference to, the annexed drawings that form a part of the specification. The exemplary embodiment is described in detail without attempting to describe all of the various forms and modifications in which the invention might be embodied. As such, the embodiments described herein are illustrative, and as will become apparent to those skilled in the arts, may be modified in numerous ways within the scope and spirit of the invention.

Although the following text sets forth a detailed description of numerous different embodiments, it should be understood that the detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims. To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning.

Various embodiments of the invention are described herein and as depicted in the drawings. It is expressly understood that although the figures depict bows with quiver and stabilizer combinations, the invention is not limited to these embodiments. It should be further understood that the terms "arrow gripper bracket" and "bracket", and "arrow gripper" and "gripper" may be used interchangeably, respectively.

Now referring to FIG. 1, a typical compound bow 2 is provided. The central portion is a riser 4, which is a central, rigid portion of the bow 2. The riser 4 is where a user grips the bow 2, and the riser 4 provides a central location to dispose other portions of the bow 2 and various accessories. Extending upward from the riser 4 is an upper limb 6 which is affixed to the riser 4. In this embodiment, an upper bolt 8 is used to affix the upper limb 6 to the riser 4. In other embodiments, the upper bolt 8 or another fastening means may be used to adjust the interconnection between the upper limb 6 and the riser 4 to provide different performance characteristics to the bow 2. Similarly, a lower limb 10 extends downward from the riser 4, and a lower bolt 12 affixes the lower limb 10 to the riser 4.

Each of the upper limb 6 and the lower limb 10 have a proximate end, which is affixed to the riser 4, and a distal end. An upper cam 14 is disposed on the distal end of the upper limb 6, and a lower cam 16 is disposed on the distal end of the lower limb 10. A bow string 18 is operatively interconnected to each the upper cam 14 and the lower cam 16. Cams may come in a variety of forms including, but not limited to, single cams, hybrid cams, dual cams, binary cams, quad cams, and hinged cams. As a user engages the bow 2 and pulls on the bow string 18, the upper cam 14 and the lower cam 16 rotate as the limbs 6, 10 begin to flex. When the cams 14, 16 completely rotate, the draw weight of the bow string 18 lets off, or in other words, the draw weight decreases from the peak draw weight. This allows an archer to maintain a drawn bow string 18 with less effort. The "let off" may be expressed in term of a percentage of the peak draw weight of the bow string 18. Let off is typically between 60-85% of the peak draw weight of the bow string 18. This means that a bow 2 may let off 60% of the peak draw weight of the bow string 18, and the user needs to maintain only 40% of the peak draw weight to keep the bow string 18 drawn. Other bows may have let off between 50-99% of the peak draw weight.

FIG. 1 also illustrates other features typically found on a bow 2. A nocking point 20 is disposed on the bow string 18 approximately halfway between the cams 14, 16. The nocking point 20 is near where the user locates an arrow on the bow string 18. A cable guard 22 extends rearward from the riser 4 and past the bow string 18. The cable guard 22 segregates additional portions of the bow string 18 from the portion of the bow string 18 that comprises the nocking point 20 such that the additional portions do not interfere with the arrow. A bow sight 24 is disposed on the riser 4 and aids the user in visualizing where a fired arrow will travel. The riser 4 also comprises an arrow rest 26, which is where the shaft of a projectile rests as a user engages the bow 2. Finally, the riser 4 comprises a grip 28, which is the portion of the riser 4 that the user grips with his or her off hand.

Also depicted in FIG. 1 is a stabilizer 30. The stabilizer 30 in this embodiment of the invention is affixed to the riser 4 of the bow 2, and the stabilizer 30 extends forward from the bow 2. The bow 2 may comprise a threaded female recess disposed on the forward end of the bow 2, and the stabilizer 30 may comprise a threaded male insert such that an archer may screw the stabilizer 30 into the bow 2. Embodiments of the invention may comprise similar attachment means and other attachments means discussed herein. As mentioned elsewhere herein, the general purpose of the stabilizer 30 is to provide balance to the bow 2, to dampen vibrations as an arrow is fired, and to aid a user in holding a drawn bow 2 steady.

Figure 2:
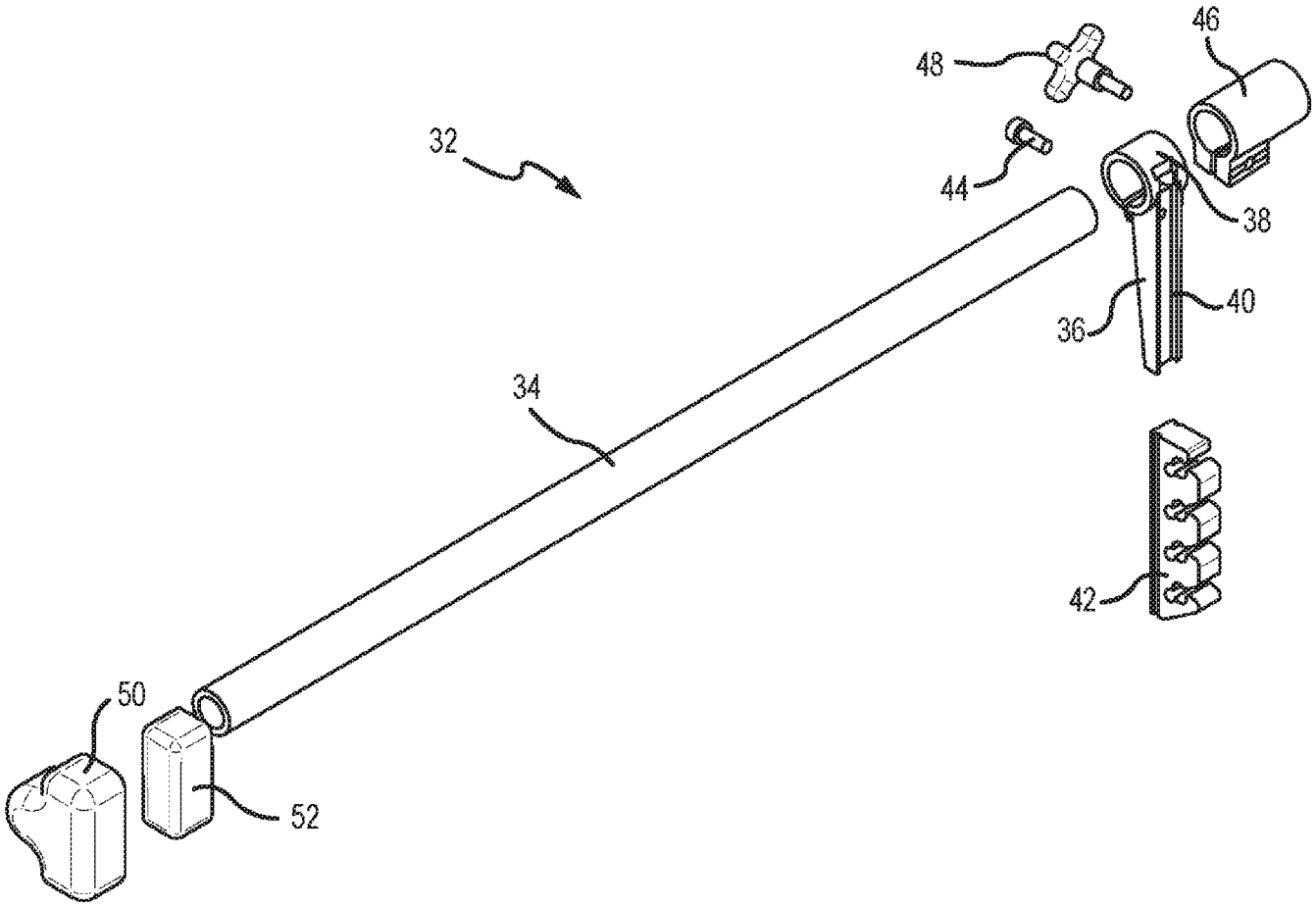
FIG. 2 is an exploded perspective view of a combined stabilizer/quiver according to one embodiment of the invention.

Now referring to FIG. 2, an embodiment of a combined stabilizer/quiver 32 for a bow is provided. A shaft 34 provides length to the stabilizer/quiver 32, and in this embodiment, the shaft 34 is cylindrically shaped having a proximal end and a distal end. An arrow gripper bracket 36 may be disposed about the shaft 34 towards the proximate end of the shaft 34. A first portion 38 of the arrow gripper bracket 36 may be disposed around the shaft 34, and the first portion 34 is cylindrically shaped but comprises a longitudinally disposed gap. A lockdown bolt 44 may be used to secure the arrow gripper bracket 36 to the shaft 34. As a user engages the lockdown bolt 44, the longitudinally disposed gap of the first portion 34 closes, and the first portion 34 of the arrow gripper bracket 36 compresses onto the outer surface of the shaft 34 of the stabilizer/quiver 32.

The arrow gripper bracket 36 shown in FIG. 2 also comprises a second portion 36 that extends outward, radially from the shaft 34 of the stabilizer/quiver 32. The second portion 36 comprises a recess and two ridges. An arrow gripper 42 comprises two grooves which correspond to the two ridges of the second portion 40. This allows the arrow gripper 42 to longitudinally slide into the second portion 40 of the arrow gripper bracket 36. The lockdown bolt 44 may secure the first portion 38 to the shaft 34, and the lockdown bolt 44 may also continue through the first portion 38, through the second portion 40, and into the arrow gripper 42 in order to secure the arrow gripper 42 to the second portion 40. It will be appreciated that there may be other embodiments of the invention where the arrow gripper 42 snaps into the second portion 40 or is secured on the second portion 40 with other attachment means. In yet further embodiments, the arrow gripper 42 is screwed onto the second portion 40, is welded to the second portion 40, or is a single continuous structure with the second portion 40. The arrow gripper 42 may interface with the second portion 40 via any means commonly known in the art.

The arrow gripper 42 comprises at least one slot or aperture devoted to securing the body or shaft of an arrow. This slot comprises a portion that is approximately the same diameter as the arrow's body or shaft, but the slot also comprises an entry portion that is smaller than the diameter of the arrow's body or shaft. This configuration allows an arrow to snap into place in the arrow gripper 42, which secures the arrow by virtue of the entry portion that has a diameter smaller than the arrow's body or shaft.

Next, a bow attachment 46 is disposed around the shaft 34 of the stabilizer/quiver 32 towards the proximate end of the stabilizer/quiver 32. The bow attachment 46 is similar to the first portion 38 of the arrow gripper bracket 36. The bow attachment 46 is cylindrically shaped with a longitudinal gap. A quick detach knob 48 is used to secure the bow attachment 46 to the shaft 34 of the stabilizer/quiver 32 and to a portion of the riser 4 of the bow 2. As a user engages the quick detach knob 48, the longitudinal gap closes and the bow attachment 46 compresses onto the outer surface of the shaft 34 of the stabilizer/quiver 32. The bow attachment 46 may also be screwed, welded, formed continuously with, snapped, and and/or secured to the shaft 34 via any other means of interconnection discussed herein or commonly known in the art.

FIG. 2 shows a broadhead hood 50 disposed on the distal end of the shaft 34 of the stabilizer/quiver 32. The broadhead hood 50 may be secured by means of a compression or interference fit. In other embodiments, the broadhead hood 50 may be secured by the lockdown bolt or the quick detach knob used by the arrow gripper bracket 36 and the bow attachment 42, respectively.

The broadhead hood 50 comprises a housing with a recess configured to receive a broadhead hood insert 52. The tips of arrows are typically fitted with a broadhead for hunting purposes, and broadheads generally comprise at least one sharpened edge, which can present a danger to the user if the sharpened edge is exposed. Thus, the broadheads may be disposed and secured in the broadhead hood insert 52. The broadhead hood insert 52 may comprise a material that is punctured by the broadhead of an arrow, then the material compresses around the broadhead. In other embodiments, the material is cut out into a shape that receives and secures a broadhead. The material may be foam rubber, rubber, polyethylene, or other material commonly used in the art, and the broadhead hood insert 52 may comprise an adjustable feature such as a screw that allows an archer to compress the rubber around the broadhead. In yet further embodiments, the broadhead hood insert 52 may comprise locking features that snap into a notch or other geometrical feature of the broadhead. In this embodiment, the number of locking features may be greater than, less than, or equal to the number of slots in the arrow gripper 42.

Another feature of the stabilizer/quiver 32 is the ability to dampen vibrations caused by operation of the bow 2. The shaft 34 itself may be adjustable in length and/or shape. A shaft 34 configured in different shapes and disposed in different locations will provide different moment forces about the center of the bow's 2 mass, and thus different dampening and stabilizing properties. In addition, the shaft 34 will provide different mode shapes and frequencies. The shape of the shaft 34 may be manipulated with multiple segments, and the shaft 34 may be a shape other than a cylinder. For example, a square shaft, a shaft with a plurality of ribs, and/or a shaft with a plurality of apertures may provide optimum dampening qualities. Further, the shaft 34 may be encased in or cored with rubber, vibration foam, or any other material that enhances the vibration dampening properties of the combined stabilizer/quiver 32.

An archer may adjust the shaft 34 until the desired dampening shape is achieved. In some embodiments of the invention, the shaft 34 comprises a hollow, enclosed volume which may be filled with a liquid. A shaft 34 with a liquid core may also provide enhanced dampening properties. Further, different segments of a segmented shaft 34 may be filled with various liquids, and other segments of the segmented shaft 34 may remain solid or hollow. In a single shaft 34 design, the interior of the shaft 34 may comprise a plurality of compartments which may be filled with a liquid. Further, the sides of the shaft 34 may be clear such that an archer may discern the amount of liquid in each compartment. Liquids may be water, and liquids may be less or more dense than water such as oil and mercury.

Other embodiments of the invention may employ other means to effectuate the dampening properties of the stabilizer/quiver 32. The shaft may comprise a piston with an electronic timing system such that the piston is displaced as an archer fires an arrow. In this embodiment a sensor may be disposed on the limbs 6, 10 such that the sensor discerns when the bow is drawn, then when the bow string 18 is release. The sensor may be in electronic communication with the stabilizer/quiver 32 and the piston system. When the sensor detects the bow string 18 release, the piston may adjust its position within the shaft 34 of the stabilizer/quiver 32 to counteract the flexing of the limbs 6, 10, and the propulsion of the projectile. In other embodiments, a spring system or hydraulic system may be employed within the shaft 34. It will be appreciated that commonly known dampening devices may be passively or actively used in the shaft 34 of the stabilizer/quiver 32 to improve the dampening and stabilizing properties of the stabilizer/quiver 32.

Figure 3:
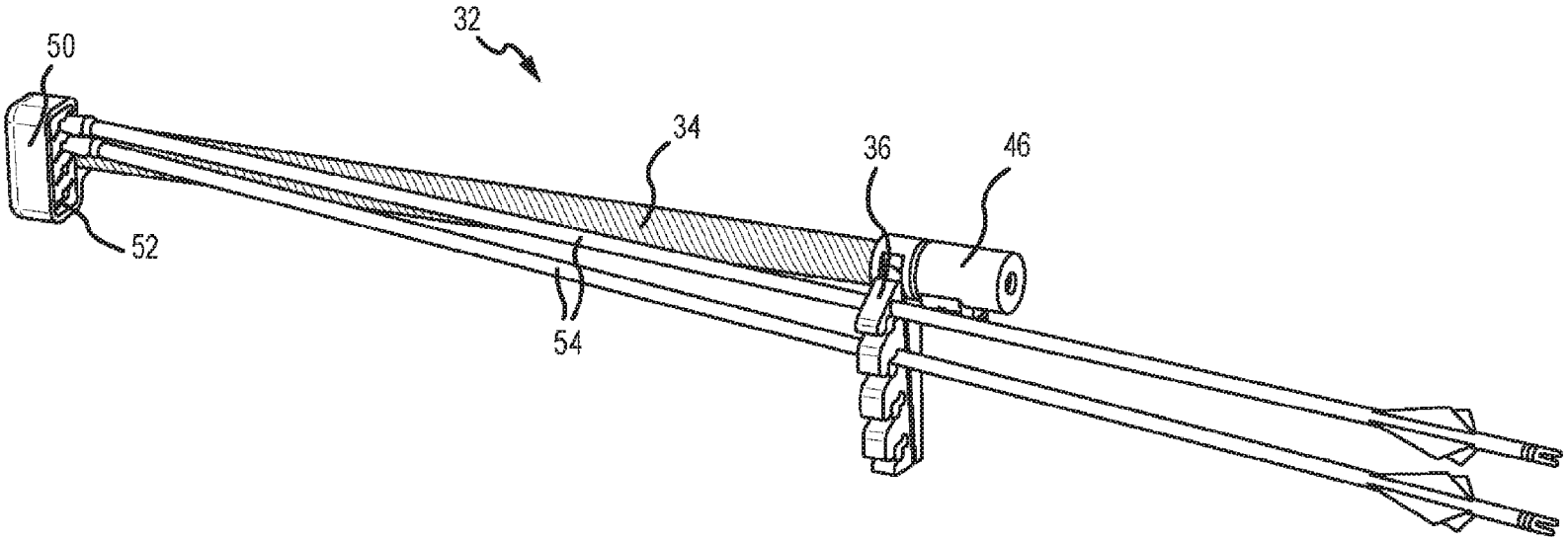
FIG. 3 is a perspective view of an assembled stabilizer/quiver according to one embodiment of the invention wherein arrows are disposed within the stabilizer/quiver.

Now referring to FIG. 3, a stabilizer/quiver 32 is provided where arrows 54 are disposed in the stabilizer/quiver 32. The bodies or shafts of the arrows 54 are disposed in the slots of the arrow gripper bracket 36, and the broadhead of the arrow is disposed in the broadhead hood insert 52. Also shown in FIG. 3 is the proximate end of the bow attachment 46, which may be screwed into a portion of the riser 4 of the bow 2. In other embodiments, the bow attachment 46 may compress about a portion of the riser 4 similar to how the bow attachment 46 may compress around the outer surface of the shaft 34 of the stabilizer/quiver 32.

The broadhead hood 50, the arrow gripper bracket 36, and the bow attachment 46 are all adjustable along the length of the shaft 34 of the stabilizer/quiver 32. In one embodiment, the broadhead hood 50 remains disposed on the distal end of the shaft 34, and the arrow gripper bracket 36 and the bow attachment 46 are moveable towards the distal end of the shaft 34 and are adjustable as far as the broadhead hood 50. In this configuration, the shaft 34 and the arrows 54 are moved rearward relative to the riser 4 of the bow 2. In another embodiment, the broadhead hood 50 is movable towards the proximate end of the shaft 34 and is adjustable as far as the arrow gripper bracket 36 and/or the bow attachment 54. In this configuration, the shaft 34 remains extended forward as a traditional stabilizer, but the arrows 54 are disposed substantially rearward of the riser 4 of the bow 2. In yet another embodiment, the arrow gripper bracket 36 is disposed on the proximate end of the shaft 34, the broadhead hood 50 is disposed on the distal end of the shaft 34, and the bow attachment 46 is disposed on the shaft 34 therebetween. The bow attachment 46 may then be adjusted or moved along the length of the shaft 34. In this configuration, the shaft 34 and the arrows 54 move forward or rearward of the riser 4 of the bow 2.

Figure 4:
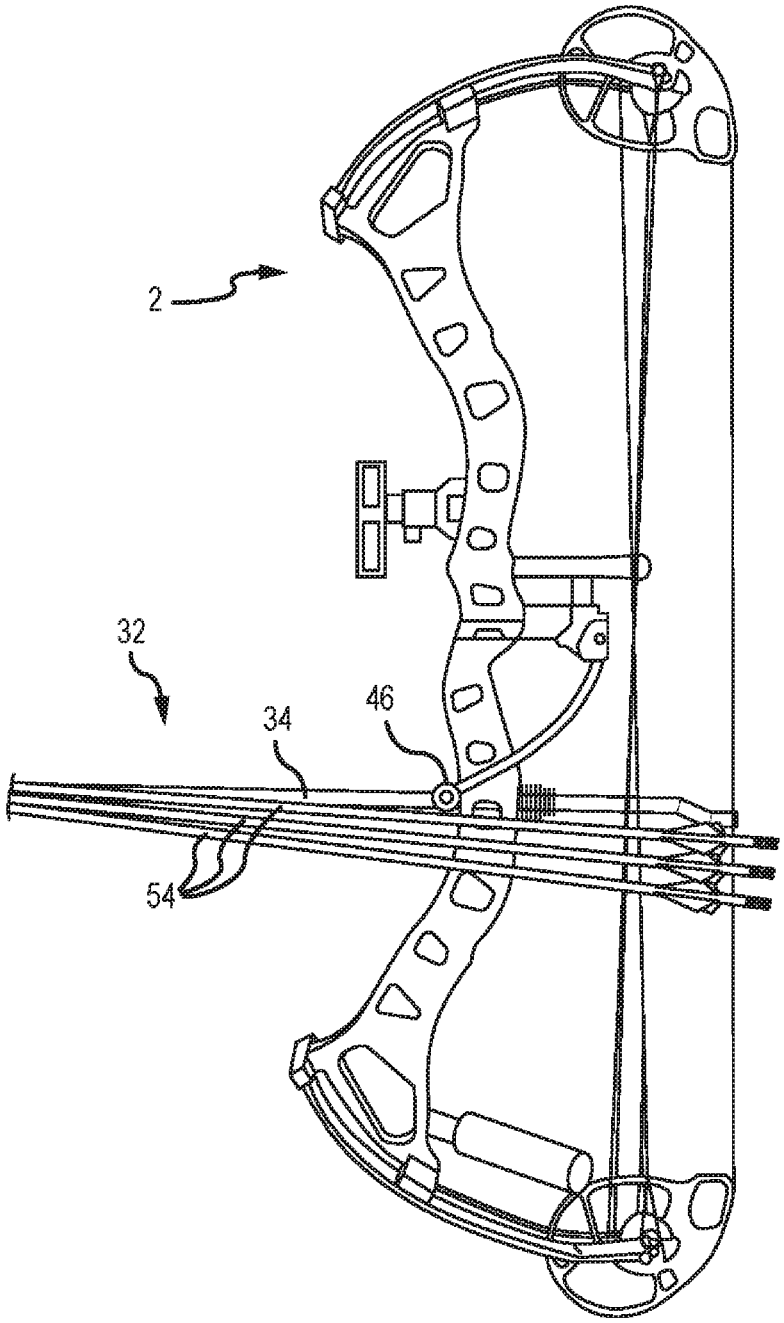
FIG. 4 is a side elevation view of a stabilizer/quiver according to one embodiment of the invention wherein the stabilizer/quiver is attached to a riser of a bow.

Now referring to FIG. 4, a stabilizer/quiver 32 attached to a bow 2 is provided. The bow attachment 46 is secured to the riser 4 of the bow 2, and the arrows 54 are disposed to one side of the riser 4. In some embodiments, the bow attachment 46 may be secured to the front side of the riser 4, and in other embodiments, the bow attachment 46 may be secured to the sides or the back of the riser 4. Further, the arrows 54 may be arrayed on one side of the riser 4, on both sides of the riser 4, or through the riser 4.

The arrow gripper 42 and the arrow gripper bracket 36 may attach to the shaft 34 of the stabilizer/quiver 32 in some embodiments of the invention, but in other embodiments the shafts of the arrows may be secured onto features of the riser 4 or the limbs 6, 10 or any other component discussed herein.

In some embodiments, the stabilizer/quiver 32 is between 1 inch and 55 inches in length. In various embodiments, the stabilizer/quiver 32 is 12 inches to 50 inches in length. In some embodiments, the stabilizer/quiver 32 is 4 inches to 12 inches in length.

Figure 5:
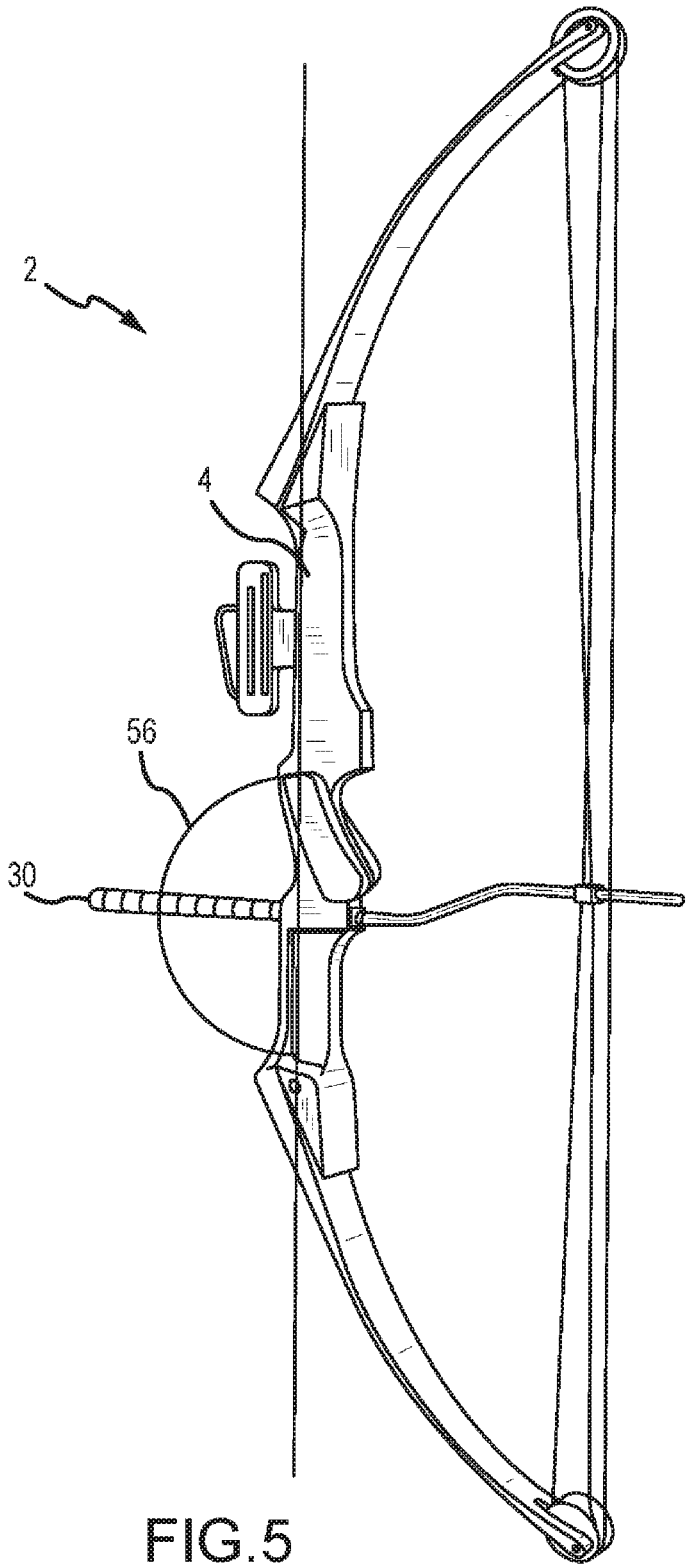
FIG. 5 is a side elevation view of a stabilizer/quiver according to one embodiment of the invention showing a vertical angle between the stabilizer/quiver and a riser.
Figure 6:
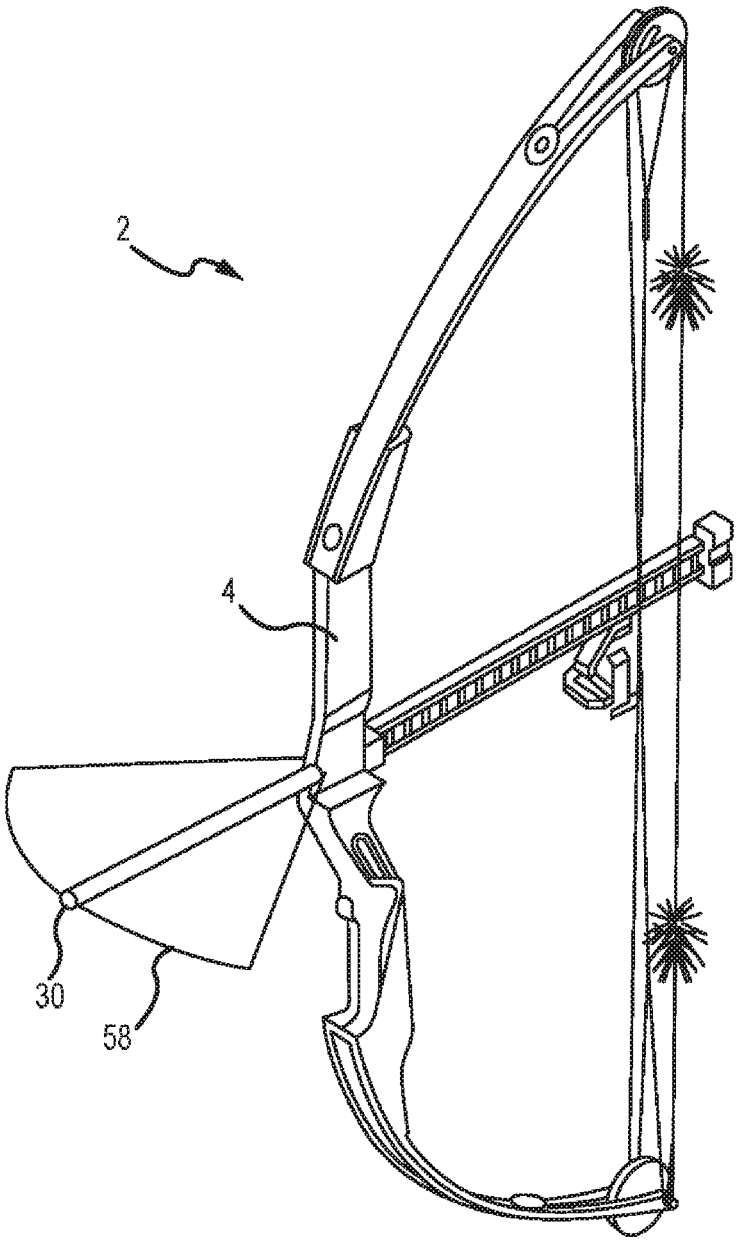
FIG. 6 is a perspective view of a stabilizer/quiver according to one embodiment of the invention showing a horizontal angle between the stabilizer/quiver and a riser.

Now referring to FIGS. 5 and 6, the stabilizer 30 is adjustable at various angles relative to the bow 2, specifically the riser 4 of the bow 2. It should be understood that while the stabilizer 30 is used for exemplary purposes, the same adjustability concepts apply to the stabilizer/quiver 32 in accordance with embodiments described elsewhere herein.

FIG. 5 shows that the stabilizer 30 may be adjustable in a plane through the vertical axis of the riser 4 and the longitudinal axis of the stabilizer 30. A vertical angle 56 may be measured from a substantially horizontal plane. In the embodiment shown in FIG. 5, the stabilizer is adjustable between 90 and −90 degrees from the horizontal plane. In other embodiments, the stabilizer 30 is fully adjustable about an axis, which means that the stabilizer 30 may rotate a full 360 degrees. The stabilizer 30 may be secured in various positions using a thumbscrew to, for example, impinge on a ball portion of a ball-and-socket joint to secure the stabilizer 30 in place. In other embodiments, the stabilizer 30 may be secured in various positions using an interference fit. For example, a protrusion on one component such as the stabilizer 30 may correspond to a depression in another component such as the riser 4. When the protrusion and depression are aligned, there is no interference, but when the protrusion and depression fall out of alignment, the protrusion interferes with the non-depression portion of the riser 4. Thus, this interference maintains the orientation of the stabilizer 30 relative to the riser 4. A user may press the protrusion through the interference such that the protrusion is aligned with a second depression, and the stabilizer 30 is maintained in a second position relative to the riser 4. A level such as a bubble level may be integrated into the stabilizer 30 to help a user such as a hunter orient the stabilizer 30 relative to the ground.

FIG. 6 shows a perspective view of a bow 2 comprising a stabilizer 30 wherein the stabilizer is adjustable in a horizontal plane through the longitudinal axis of the stabilizer 30 and substantially parallel to the ground when the bow 2 is in a firing position. A horizontal angle 58 is measured between the stabilizer 30 and a vertical plane through the vertical axis of the riser 4 and the longitudinal axis of the stabilizer 30 or a vertical plane through the vertical axis of the riser 4 and the string. In the embodiment depicted in FIG. 6, the horizontal angle 58 may extend between 45 and −45 degrees. In other embodiments, the stabilizer 30 may be rotatable such that the stabilizer 30 extends rearward of the riser 4. In other words, the horizontal angle 58 may extends between 180 and −180 degrees. In some embodiments, the adjustable orientation of the stabilizer 30 may be achieved with one or more rotatable axes disposed in the bow attachment 46, a ball and socket joint, or any other joint commonly used to manipulate the position of an object.

Figure 7:
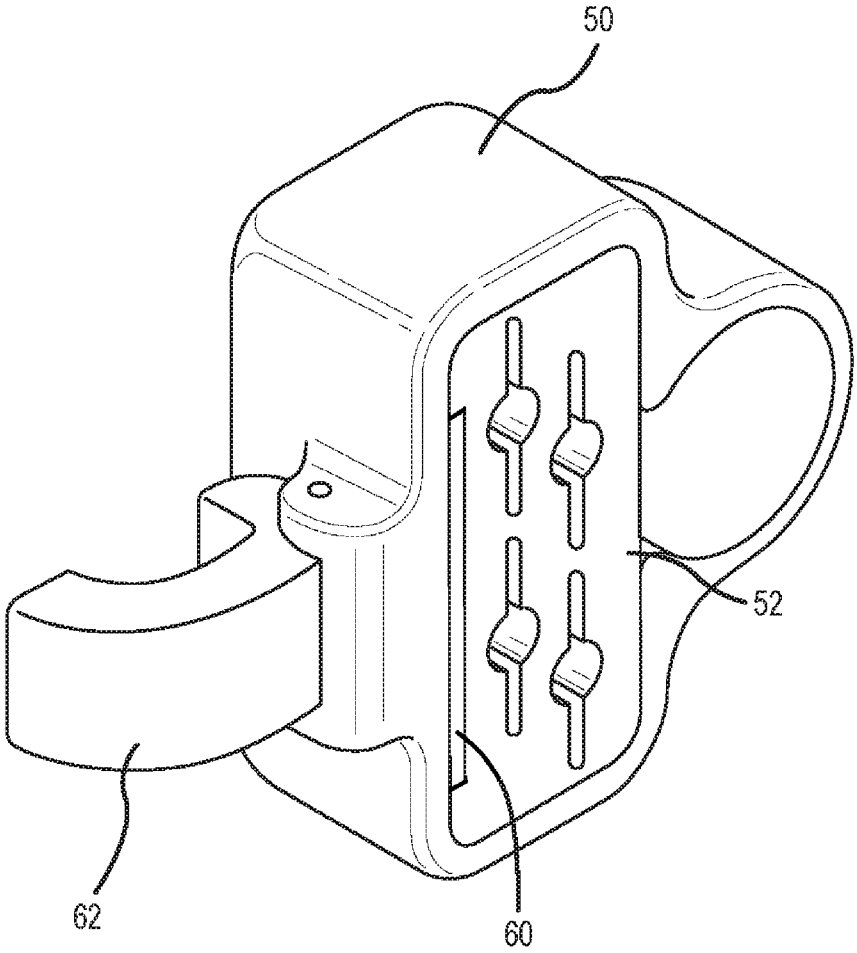
FIG. 7 is a perspective view of a broadhead hood according to one embodiment of the invention wherein a tension lever is open.

Now referring to FIG. 7, a detailed view of a broadhead hood 50 is provided. In this embodiment, the broadhead hood 50 comprises a housing where a broadhead hood insert 52 may be disposed. In this particular embodiment, the broadhead hood insert 52 is a foam rubber insert with recesses that receive broadheads or other arrowheads, but other embodiments may be comprised of other materials that deform in response to a force such as a physical or electromagnetic force. Some materials may have a volume fraction that characterizes the volume percentage of a particular material or void. For example, a low density foamed rubber may have a void fraction between approximately 35% and 80%. In some embodiments, the broadhead hood insert 52 is a material that has a void fraction between approximately 10% and 90%. In various embodiments, the broadhead hood insert 52 is a material that has a void fraction between approximately 35% and 80%. In some embodiments, the broadhead hood insert 52 is a material that has a void fraction of approximately 40%.

Adjacent to the broadhead hood insert 52 is a tension plate 60, which is disposed along the majority of one surface of the broadhead hood insert 52.

Disposed on the outer surface of the broadhead hood 50 is a tension lever 62, which pivots about a pin or axis. The tension lever 62 comprises two ends: a handle end that extends outwardly from the broadhead hood 50 and a lever end that is operably interconnected to the tension plate 60. In some embodiments, the handle end extends further from the pin or axis than the lever end. The tension lever 62 depicted in FIG. 7 is in an open position, meaning that the tension lever 62, specifically the lever end, is not imparting any force on the tension plate 60.

Figure 8:
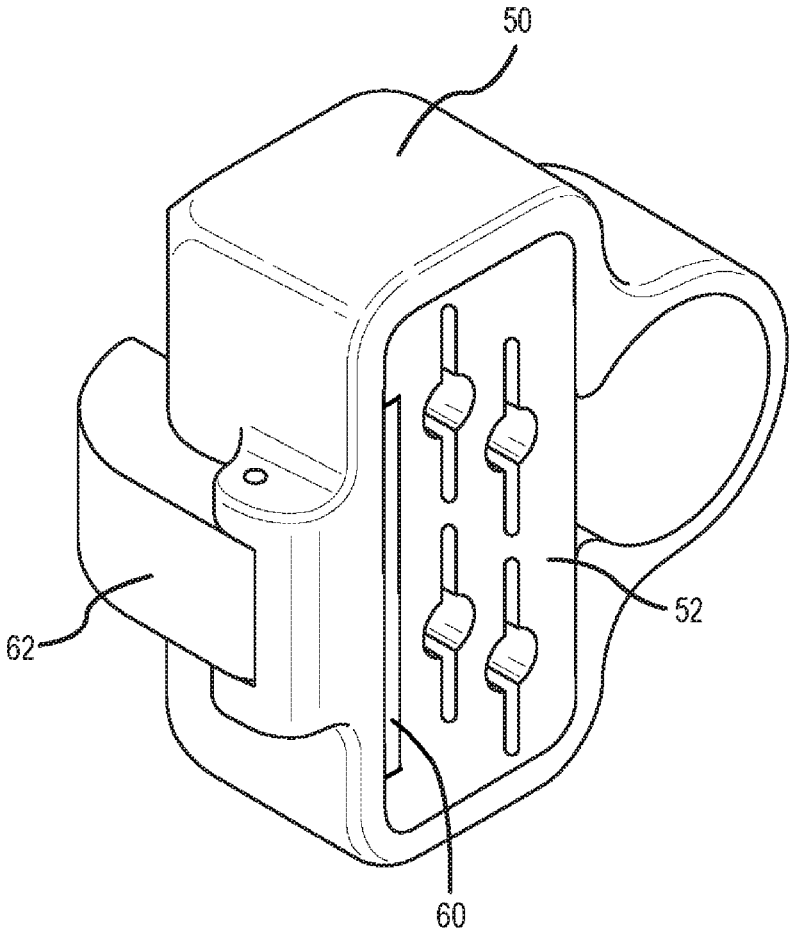
FIG. 8 is a perspective view of a broadhead hood according to one embodiment of the invention wherein a tension level is closed.

Now referring to FIG. 8, the tension lever 62 of the embodiment shown in FIG. 7 is in a closed position. Now the tension lever 62 has pivoted about the pin or axis, the handle end of the tension lever 62 extends alongside the broadhead hood 50, and the lever end of the tension lever 62 has pivoted into the tension plate 60. The physical force from the tension lever 62 causes the tension plate 60 to press into the broadhead hood insert 52, which causes the broadhead hood insert 52 to deform and press into the broadheads or other arrowheads that are disposed within the broadhead hood insert 52. In the embodiment depicted in FIGS. 7 and 8, the four cutouts for the broadheads are arranged in a staggered fashion. Other embodiments may have a different number of cutouts, different arrangement of cutouts, etc. Further, in the embodiments depicted in FIGS. 7 and 8, the tension plate 60 is disposed along one side of the broadhead hood insert 52 such that the tension plate 60 presses against the flat side of the broadheads. In other embodiments, the tension plate 60 may be disposed along another surface or surfaces such that engagement of the tension lever 62 causes the tension plate 60 to press against the broadheads at a different angle.

The invention has significant benefits across a broad spectrum of endeavors. It is the Applicant's intent that this specification and the claims appended hereto be accorded a breadth in keeping with the scope and spirit of the invention being disclosed despite what might appear to be limiting language imposed by the requirements of referring to the specific examples disclosed.

The phrases "at least one", "one or more", and "and/or", as used herein, are open-ended expressions that are both conjunctive and disjunctive in operation. For example, each of the expressions "at least one of A, B, and C", "at least one of A, B, or C", "one or more of A, B, and C", "one or more of A, B, or C," and "A, B, and/or C" means A alone, B alone, C alone, A and B together, A and C together, B and C together, or A, B, and C together.

Unless otherwise indicated, all numbers expressing quantities, dimensions, conditions, and so forth used in the specification, drawings, and claims are to be understood as being modified in all instances by the term "about."

The term "a" or "an" entity, as used herein, refers to one or more of that entity. As such, the terms "a" (or "an"), "one or more" and "at least one" can be used interchangeably herein.

The use of "including," "comprising," or "having," and variations thereof, is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C., Section 112(f). Accordingly, a claim incorporating the term "means" shall cover all structures, materials, or acts set forth herein, and all of the equivalents thereof. Further, the structures, materials, or acts, and the equivalents thereof, shall include all those described in the summary of the invention, brief description of the drawings, detailed description, abstract, and claims themselves.

The foregoing description of the invention has been presented for illustration and description purposes. However, the description is not intended to limit the invention to only the forms disclosed herein. In the foregoing Detailed Description for example, various features of the invention are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate embodiment of the invention.

Consequently, variations and modifications commensurate with the above teachings and skill and knowledge of the relevant art are within the scope of the invention. The embodiments described herein above are further intended to explain best modes of practicing the invention and to enable others skilled in the art to utilize the invention in such a manner, or include other embodiments with various modifications as required by the particular application(s) or use(s) of the invention. Thus, it is intended that the claims be construed to include alternative embodiments to the extent permitted by the prior art.

What is claimed is:

1. A selectively detachable stabilizer and quiver for a bow, comprising:

a stabilizing member configured to extend from a riser of a bow, said stabilizing member having a proximate end, a distal end, a longitudinal axis extending therebetween, and an outer surface;

a threaded male end positioned on said proximate end of said stabilizing member for selective interconnection of said stabilizing member to said riser of said bow;

a hood disposed about said outer surface of said stabilizing member, said hood comprising a plurality of recesses adapted to receive a plurality of arrows or broadheads, wherein said hood comprises:

a housing defining a partially enclosed volume;

a hood insert disposed in said partially enclosed volume and comprising said plurality of recesses, said hood insert is compressible between a first volume and a second volume;

a tension plate at least partially disposed within said partially enclosed volume, said tension plate disposed adjacent to said hood insert;

a tension lever pivotally interconnected to said outer surface of said housing, said tension lever having a handle end and a lever end, wherein said handle end extends further from said pivot interconnection than said lever end, and wherein said lever end is operably interconnected to said tension plate; and wherein pivoting said tension lever from an open position to a closed position causes said lever end of said tension lever to press into said tension plate, which causes said tension plate to compress said hood insert from said first volume to said second volume.

2. The stabilizer and quiver of claim 1, wherein said hood is located near said distal end of said stabilizing member.

3. The stabilizer and quiver of claim 1, wherein said stabilizer member is configured to rotate through at least one plane.

4. The stabilizer and quiver of claim 1, wherein said hood insert is comprised from at least one of foam rubber, rubber, and polyethylene.

5. The stabilizer and quiver of claim 1, further comprising a bracket interconnected to said outer surface of said stabilizing member proximate to said riser, said bracket adapted to receive and secure shafts of said plurality of arrows or broadheads.

6. The stabilizer and quiver of claim 1, wherein said plurality of arrows or broadheads is oriented along a longitudinal axis, and said hood is configured to orient said longitudinal axis of said plurality of arrows or broadheads substantially parallel to said longitudinal axis of said stabilizing member.

7. The stabilizer and quiver of claim 1, further comprising an arrow gripper disposed about said outer surface of said stabilizing member, said arrow gripper comprising a plurality of slots configured to receive a portion of said plurality of arrows or broadheads.

8. The stabilizer and quiver of claim 7, wherein said arrow gripper is positioned between said hood and said threaded male end along said stabilizing member.

9. The stabilizer and quiver of claim 1, wherein said stabilizing member is configured to rotate about a vertical plane that extends through said riser of said bow, wherein an angle between said longitudinal axis of said stabilizing member and a longitudinal axis of a string of said bow is between approximately 90 degrees and −90 degrees relative to a horizontal plane that extends through said riser of said bow.

10. The stabilizer and quiver of claim 1, wherein said stabilizing member is configured to rotate through a horizontal plane that extends through said riser of said bow, wherein an angle between said longitudinal axis of said stabilizing member and a longitudinal axis of a string of said bow is between approximately 45 degrees and −45 degrees relative to a vertical plane that extends through said riser of said bow.

* * * * *